United States Patent [19]

Chateau et al.

[11] 4,095,649

[45] Jun. 20, 1978

[54] REENTRY SYSTEM FOR SUBSEA WELL APPARATUS

[75] Inventors: Georges M. Chateau, Pau, France; Chester B. Falkner, Jr., Huntington Beach, Calif.

[73] Assignee: Societe Nationale Elf Aquitaine (Production), Courbevoie, France

[21] Appl. No.: 759,032

[22] Filed: Jan. 13, 1977

[51] Int. Cl.[2] ..... E21B 7/12

[52] U.S. Cl. ..... 166/0.5; 33/180 R; 285/27; 175/7; 61/69 R

[58] Field of Search ..... 166/0.5, 0.6; 33/180 R, 33/181 R; 114/16.4, 16.6, 16.5, 16.7, 16.8; 285/18, 24, 27, 265; 61/69; 175/7

[56] References Cited

U.S. PATENT DOCUMENTS

| | | | |
|---|---|---|---|
| 1,803,199 | 4/1931 | Melms | 114/16.7 |
| 2,808,229 | 10/1957 | Bauer et al. | 175/7 |
| 3,050,138 | 8/1962 | Outwin et al. | 175/7 |
| 3,090,437 | 5/1963 | Geer | 285/27 |
| 3,301,322 | 1/1967 | Newsome | 166/0.5 |
| 3,313,347 | 4/1967 | Crain | 166/0.5 |
| 3,401,746 | 9/1968 | Stevens et al. | 166/0.5 |
| 3,513,909 | 5/1970 | Peterman et al. | 175/7 X |
| 3,517,737 | 6/1970 | Petersen | 166/0.6 |
| 3,602,301 | 8/1971 | James | 166/0.5 |

*Primary Examiner*—Ernest R. Purser
*Assistant Examiner*—Richard E. Favreau
*Attorney, Agent, or Firm*—Poms, Smith, Lande & Glenny

[57] ABSTRACT

A reentry system for a subsea apparatus or station including a normally retracted guide post, which is extendable above the well apparatus for connection to a single guide line. A frame structure lowered along the single guide line includes a gimbal mounted guide funnel assembly which provides self-adjustment of the funnel assembly during a non-axial approach into axial alignment with the guide post means. The guide posts means and funnel assembly are provided with orientation and positioning means for the frame structure so that well equipment carried by the frame structure is positioned in alignment with its cooperable part on the well apparatus. A retractable, extendable guide post which is non-rotatable and which is recoverable for maintenance and service. A method of making such a reentry to a subsea well apparatus.

16 Claims, 7 Drawing Figures

80
67
81
81
79
79
68
71
75
94
97
97
96
70
91
21
100
90
91
83
84
88
85
87
87
86
71
74
76
76
65
78
VI
VI 80
67
81
79
68
71
73
75
83
94
97
100
91
100
101
21
90
70
88
74
71
72
65

31
41
41a
31a
31b
40
41b
41c
31b

REENTRY SYSTEM FOR SUBSEA WELL APPARATUS

BACKGROUND OF THE INVENTION

Subsea well operations include the installation on the sea floor of subsea well apparatus which may include wellheads, production modules, and control modules. In some subsea installations, wellhead assemblies, production head assemblies and control head assemblies may be combined into a subsea station, such as that shown and described in copending application Ser. No. 743,586, filed Nov. 12, 1976 owned by a common assignee. After such subsea installations have been made, it is often necessary to return to the subsea installation to provide service and maintenance operations which may include the recovery or retrieval of certain well equipment and the installation of other well equipment.

Reentry to such a subsea installation or station has been usually accomplished by providing a plurality of guide lines. In prior proposed systems, such guide lines were supported below the surface of the water by suitable buoys or were permitted to fall and lay along the sea floor. When guide lines were supported by buoys, such lines were subjected to twisting by ocean currents and were often difficult to untangle for use. In addition, such upstanding lines presented a hazard to other subsea operations in the vicinity. When the guide lines were left on the sea floor, they were often difficult to retrieve in proper untangled condition.

It has, therefore, been proposed that reentry to such a subsea station be accomplished by attaching a single guide line to the station by automatic and remote control means, which could seek an upstanding guide post fixed to the subsea installation, automatically connect one end of a single guide line to such post, and then use the single guide line for guide means to lower well equipment of other sets of guide lines upon which well equipment could be lowered to the subsea station. Such fixed guide posts at a subsea station were exposed because of their length, were subject to damage, and were subject to constant exposure to the sea water whereby its condition after a long period of time made the guide post unsuitable for use.

Such prior conditions and prior proposed solutions to reentry to a subsea well apparatus are shown and described in U.S. Pat. Nos. 3,493,043; 3,503,442; 3,513,909 and 3,605,884, which show installation and use of a single or mono guide line apparatus and method.

SUMMARY OF INVENTION

This invention relates to a subsea reentry system and method of conducting such a reentry, the system having a novel, unique guide post construction and a cooperable guide frame structure which, during approach to the guide post, is self-adjusting in its orientation therewith to assure proper engagement with the guide post and positioning relative to the well apparatus. The unique guide post construction includes a retractable hydraulically actuated guide post means which in retracted position is protected and sealed and which in extended position is readily engageable for attachment of a single guide line thereto. The cooperable guide frame structure includes a gimbal funnel assembly adapted to adjust its axial position to facilitate engagement with the guide post.

The primary object of the present invention is to provide a novel guide post construction and a cooperable guide funnel assembly whereby reentry to a subsea station for service and maintenance is facilitated.

An object of the present invention is to provide a guide post means adapted to be carried by a subsea well apparatus in a protected and sealed manner whereby the corrosive effects of the hostile environment; namely, salt water, is reduced.

Another object of the present invention is to provide a pressure tight guide post construction which is retractable and extendable under remote control, and when extended serves as a target for reentry systems.

Another object of the invention is to provide such a guide post means which is readily adapted to be extended for engagement with a guide line connector under fail-safe conditions.

A further object of the present invention is to provide a fluid actuated guide post means which is readily removable for repair and service. The means for fluid actuation of the guide post means comprises a piston and cylinder means carried by the guide post means.

Still another object of the present invention is to provide a novel reentry system wherein a guide frame for sliding engagement with a single guide line includes a gimbal funnel assembly cooperable with said guide line and cooperable with said guide post for assuring proper relationship with selected equipment on the subsea well apparatus.

The invention contemplates a guide frame structure including a guide funnel assembly which may be mounted in gimbal fashion, the guide funnel assembly having a key for cooperation with a keyway on guide post means carried by the well apparatus.

The invention contemplates a method of servicing a subsea well apparatus having a single guide post means normally retracted within the apparatus and unexposed above said apparatus in which the method of reentry includes causing the guide post means to be extended upwardly above the apparatus, attaching a single guide line to the guide post means, guiding an adaptor frame structure along the single guide line toward the guide post means, engaging and adjusting the frame structure with respect to the guide post means and thereby orienting the frame structure with respect to the apparatus for guiding service means into a preselected position with respect to said apparatus.

Various other objects and advantages of the present invention will be readily apparent from the following description of the drawings in which an exemplary embodiment of the invention is shown.

IN THE DRAWINGS

Figure 1:
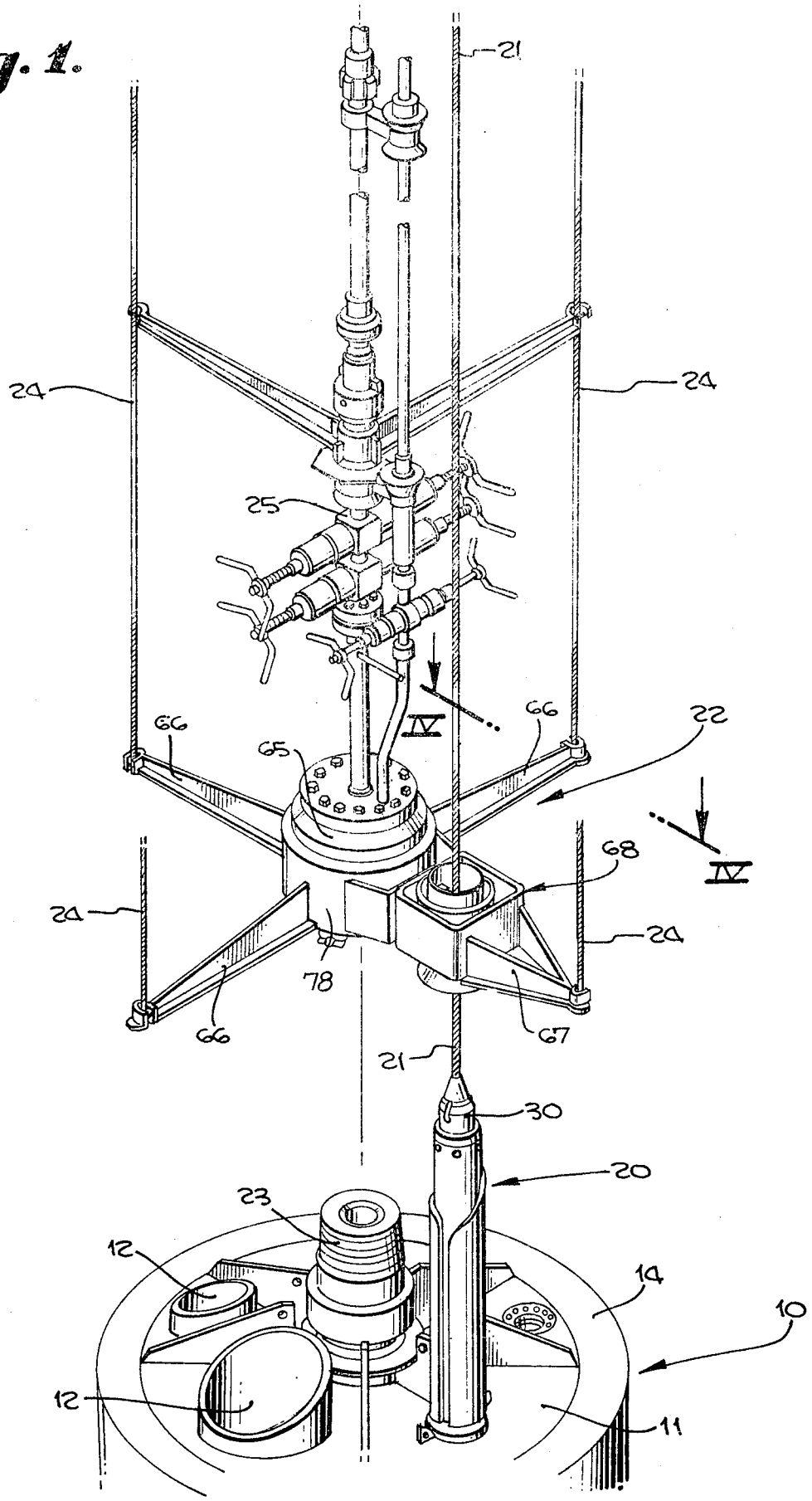
FIG. 1 is a fragmentary perspective view of the top of a subsea well apparatus equipped with a guide post means of this invention connected to a single guide line and a guide frame structure adapted to move along said line and carry a valve tree system into selected relationship with the top of the well apparatus.
Figure 3:
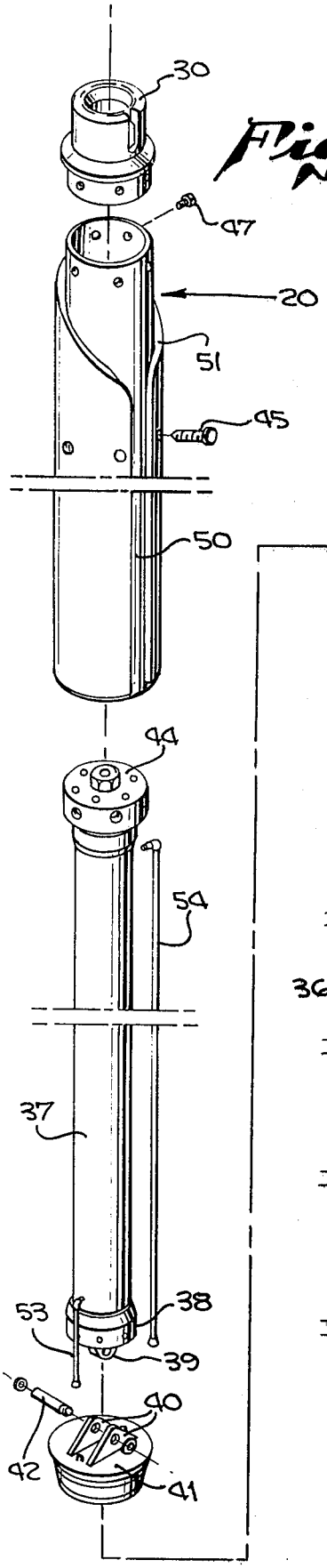
FIG. 3 is an exploded perspective view of the several component parts of the retractable guide post means shown in FIGS. 1 and 2.
Figure 6:
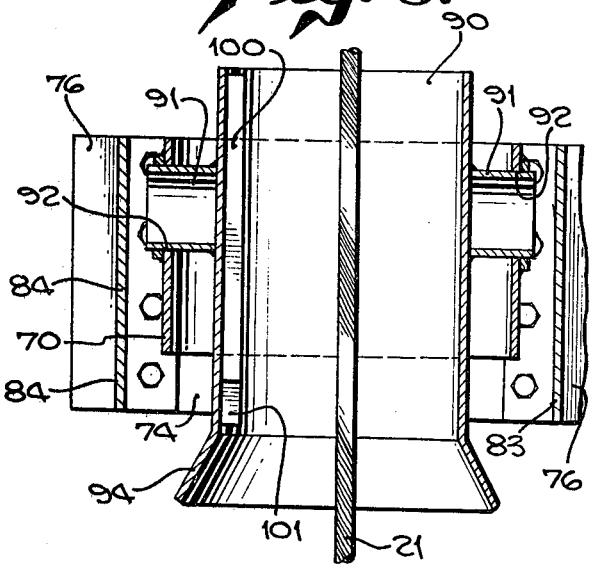
FIG. 6 is a sectional view taken in the plane indicated by line VI—VI of FIG. 4.

In FIG. 1, there is generally shown a well apparatus 10 which may form part of a subsea station such as described in copending application Ser. No. 743,586 owned by a common assignee. Well apparatus 10 may comprise a production, wellhead, or control module used on such a station and which includes various well equipment and valves for performing the well function for which it is constructed. In this example, well apparatus 10 includes a top wall 11 having a plurality of receptacles 12 thereon, each of which extends below top wall 11. The outer circumferential edge of top wall 11 includes a planar surface 14 serving as a seat upon which a diving bell having a corresponding circumferential surface may be supported in sealing relation so that service and maintenance may be performed on equipment at the top of the well by operators in a suitable environment.

Also, FIG. 1 shows a guide post means 20, a single guide line 21 connected thereto, and an adaptor frame structure 22 which is lowered along guide line 21 to provide a connection with mandrel 23. Frame structure 22 may carry a plurality of guide lines 24 which may be used for guiding additional equipment to the location of well apparatus 10. Frame structure 22 may also carry a service or workover Christmas tree arrangment 25 to facilitate working on the well apparatus 10.

Well apparatus 10, as shown and described in said copending application, provides a protective structure for well equipment carried thereby. As part of this protective feature, guide post means 20 is retractable and extendable. FIG. 1 shows guide post means 20 in full extended position. In full retracted postion, the top end 30 of the guide post is positioned at the top surface of top wall 11 of well apparatus 10. In such retracted position, guide post means 20 is received within an elongated, cylindrical receptacle 31, FIG. 2, secured by flange means 32 to flange 33 carried at the bottom of a cylindrical sleeve 34 secured to and depending from and below top wall 20. The sleeve 34 and receptacle 31 are assembled in fluid tight sealed relation to prevent leakage of sea water into receptacle 31 at the connecting flanges 32, 33 and when the diving bell is in working position on top wall 11 and sealed on surface 14. Receptacle 31 is sealed at the bottom thereof as later described.

Figure 7:
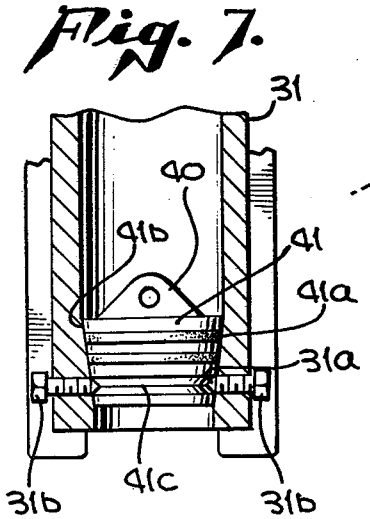
FIG. 7 is a fragmentary sectional view of the lower end of the guide post construction taken in the plane indicated by line VII—VII of FIG. 3 when assembled.

The outer cylindrical surface of receptacle 31 is provided with a plurality of longitudinally extending angularly spaced reinforcement ribs 36. Secured within receptacle 31 is a piston and cylinder means 37 having at its bottom end wall 38 a ported cleat 39, which is received within spaced cleats 40 provided on a bottom plug means 41. A pivot and securement pin 42 extends through ports in cleats 40 and 41 for connecting in non-rotatable relation the bottom end of cylinder means 37 to the receptacle 31. Plug 41, FIG. 7, is provided with seal rings 41*a* on a downwardly and inwardly tapered surface 41*b* for landing on a corresponding tapered surface 31*a* on the inerior lower end of receptacle 31. Securement bolts 31*b* extend through the lower end of receptacle 31 for locking engagement with a locking groove 41*c* on plug 41.

Piston and cylinder means 37 extends within cylindrical guide post 20 and is provided with a top head 44 which is secured intermediate ends of guide post 20 as by cap screws 45 extending through circularly arranged ports in guide post 20 and threaded bores in head 44. At the top of guide post 20, a suitable cable fitting 30 may be secured as by a plurality of cap screws 47.

Guide post 20 includes a vertically extending keyway 50 which merges with a helical ramp 51 which extends to a point near the top 30 of the guide post. The ramp and keyway 50 serve to orient frame structure 22 with respect to well apparatus 10, as later described.

Piston cylinder means 37 is a double acting cylinder means and is provided with a fluid pressure line 53 entering the bottom part of the cylinder and a fluid pressure line 54 entering the top of the fluid pressure cylinder. When fluid pressure is introduced into line 53, the piston head 44 through its connection with the guide post 20 extends the guide post upwardly beyond the surface of top wall 11 and into an extended exposed position above the well apparatus 10 for reception of a single guide line 21.

Figure 2:
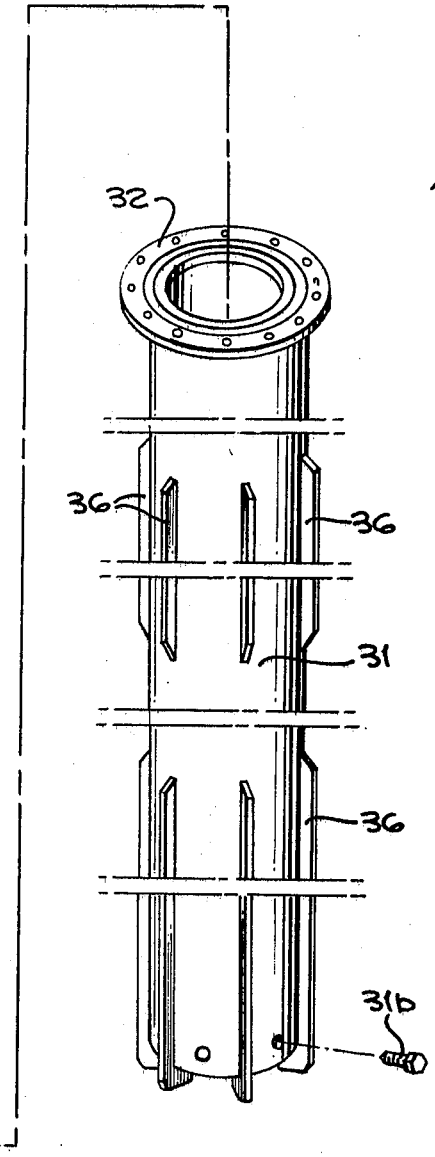
FIG. 2 is an exploded fragmentary view partly in phantom lines, showing the guide post means and its mounting on the well apparatus.
Figure 2:
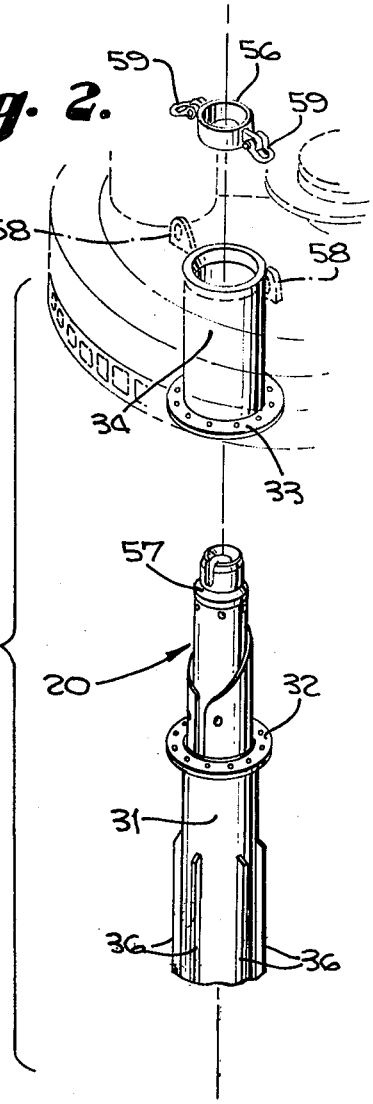

As seen in FIG. 2, when guide post 20 is in retracted position and operation of the guide post is not required, a securement clamp 56 may be placed over top end 30 of the guide post to bear against shoulder 57 thereon. Securement clamp 56 may be attached to diametrically opposite cleats 58 welded to top wall 11 and ported to received U links 59 carried by clamp 56.

When such clamp 56 is secured in place, it will be apparent that accidental or unwanted actuation of piston and cylinder means 37 will not cause the guide post 20 to move upwardly into extended position.

Guide post means 20 is shown in fully extended position in FIG. 1, the guide post means having been moved into extended position by remote control of the fluid actuated cylinder piston means. In extended position the top end of the guide post is ready for connection to a single guide line. Such a single guide line connection may be made by using "Matra's" reentry system which includes a remotely controlled sonar system for guiding a reentry cone over the top end of the guide post means and then connecting a single wire line having a connector member carried by the guide cone to the guide post by gravity. After the connection is made, the guide cone is retrieved and a single guide line remains attached to the guide post means. Such methods of attaching a single guide line to a guide post are well-known and it is understood that other methods of attaching a single guide line to a guide post than the Matra system may be employed.

Means guided by said single guide line 21 for engagement with said guide post means for positioning an adaptor frame structure 22 on said apparatus is now described.

Frame structure 22, in this example, carries a central connector means 65 for connection to the central mandrel 23 on the apparatus 10. Frame structure 22 includes three frame arms 66 of suitable metal section and a fourth frame arm 67 providing a guide funnel assembly 68 intermediate its ends. Arms 66 and 67 are spaced 90° apart and a guide line 24 may be connected to the outer end of each arm 66 and 67 to provide a set of four wire guide lines for lowering and retrieving other well equipment or tools required at the subsea well apparatus 10. Valve tree 25 is an example of such well equipment lowered and guided by guide lines 24.

Guide funnel assembly 68 guides along the single guide line 21 and includes means for self-adjusting guiding cooperation with the guide post means 20 as the frame structure 22 is lowered and approaches apparatus 10. Usually, the angle of approach of guide funnel assembly 68 to the guide post means 20 is not vertical but at somewhat of an angle thereto.

Figure 4:
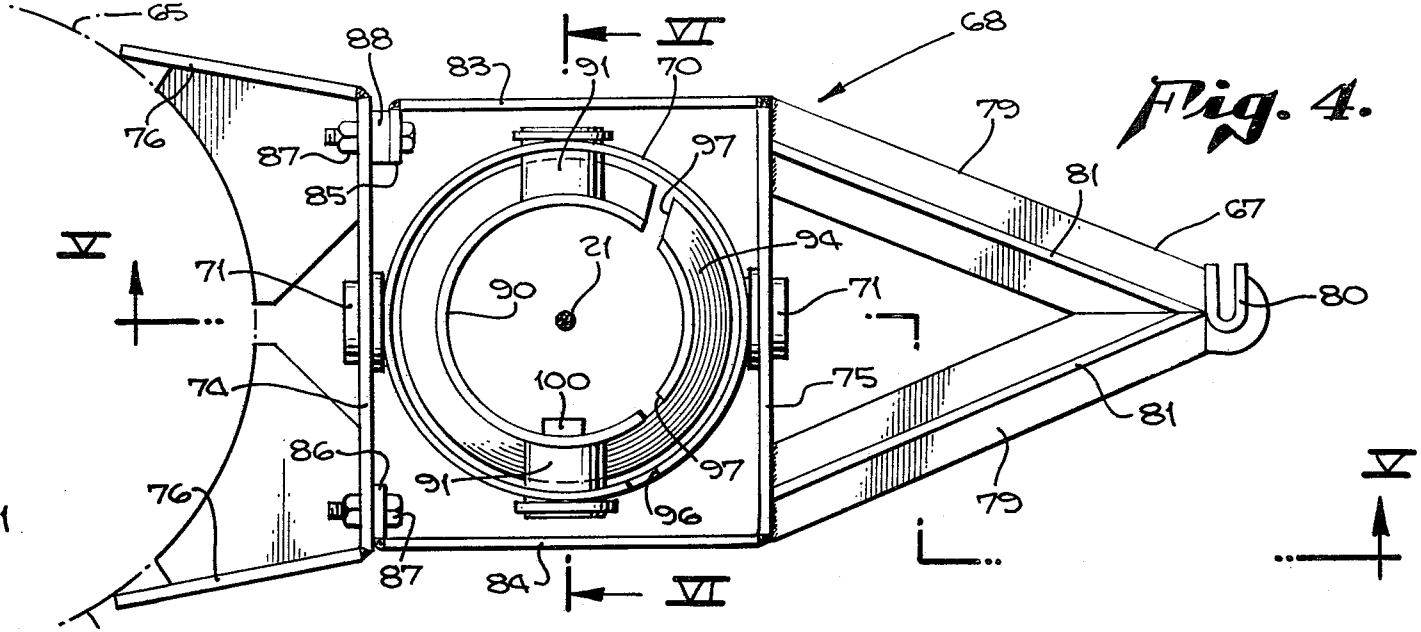
FIG. 4 is an enlarged fragmentary plan view of the arm carrying the guide funnel assembly shown in FIG. 1, the view being taken from the plane indicated at line IV—IV of FIG. 1.
Figure 5:
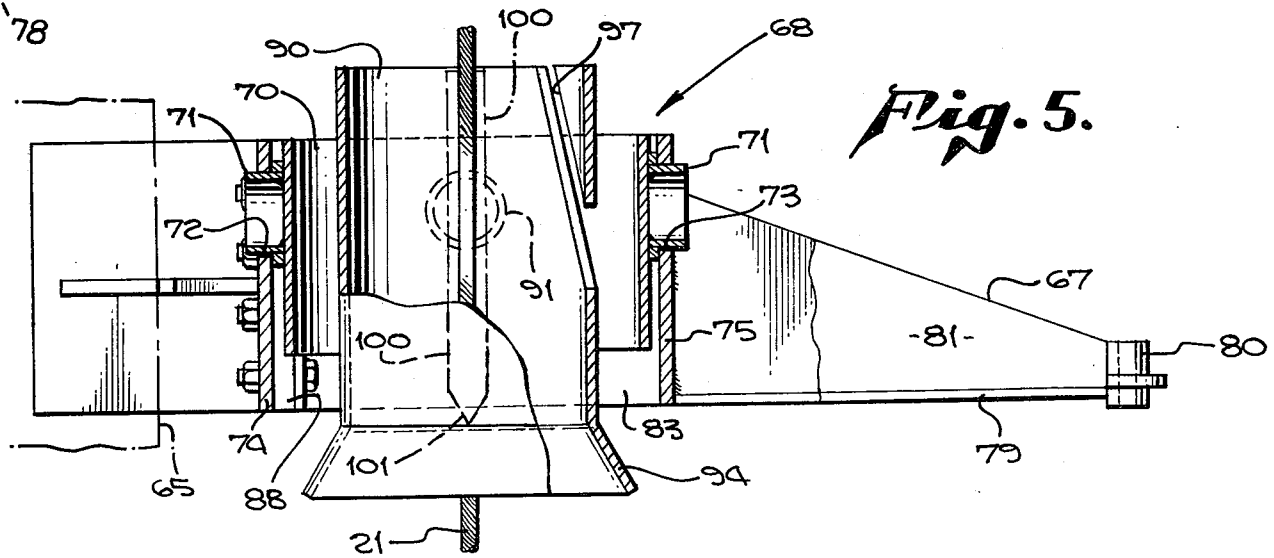
FIG. 5 is a sectional view taken in the planes indicated by line V—V of FIG. 4.

As best seen in FIGS. 4 and 5, guide funnel assembly 68 is carried intermediate ends of arm 67. Guide funnel assembly 68 includes an outer cylindrical member 70 provided with trunnions 71 rotatably mounted in diametrically opposite openings 72 and 73 on parallel walls 74 and 75. Wall 74 is connected to spaced side walls 76 secured to cylindrical member 78 within which is carried central connector 65. Wall 75 is secured as by welding to arm portions 79 of frame arm 67 which are angularly disposed, converge at their outer ends for the guide line connection at 80 and which include vertically disposed gussets 81. Outer cylindrical member 70 is carried within a polygonal framed opening defined by walls 74, 75 and side walls 83, 84, each of which has an inturned flange 85 and 86, respectively for securement as by nut and bolt assemblies 87 to wall 74. Flange 85 is spaced from wall 74, the space being closed by a spacer member 88. During assembly of the guide funnel assembly 68 with the single guide line 21, guide line 21 may be laterally inserted through the space between flange 85 and wall 74 to the interior of the framed opening. Spacer member 88 is then inserted and nut and bolt assemblies 87 secured with the guide line 21 within the polygonal framed opening.

Within the external cylindrical member 70 is mounted an internal cylindrical member 90 of reduced diameter and provided with trunnions 91 rotatably mounted in openings 92 provided in the cylindrical member 70 in diametric relation and at 90° to the trunnions 71 of the external cylinder member 70. It will thus be apparent that cylinder member 90 is provided a gimbal mounting on arm 67. Cylindrical funnel member 90 has an outwardly flared bottom wall portion 94 to facilitate approach and reception of the guide funnel assembly with respect to the top end of the guide post means 20. The gimbal mounting of the internal cylindrical guide member 90 permits self-adjustment of guide member 90 from a nonaxial position with respect to guide line 21 and guide post 20 to an axial position as the frame structure 22 is lowered over the guide post means 20.

As noted above, guide line 21 is laterally receivable within the polygonal frame by removal of the spacer member 88. Guide line 21 is also laterally receivable through a helically arranged slot 96 provided in cylindrical member 70 and then through a helicaly arranged slot 97 provided in the inner cylindrical member 90.

Means for angularly orienting and positioning frame structure 22 with respect to the well apparatus 10 and the mandrel 23 for connecting the connector 65 therewith includes a vertical key 100 located on the internal surface of interior cylindrical member 90. The angular location of key 100 is related to the fixed position of keyway 50 on guide post means 20 with respect to the apparatus 10. As frame structure 22 is lowered to the apparatus 10 and guide funnel assembly 68 is guided onto guide post 20 by the gimbal mounted inner cylindrical guide member 90, the lower tapered or pointed end 101 of key 100 contacts helical ramp 51 on guide post 20. The key 100 is guided by ramp 51 to the top entry portion of keyway 50. As key 100 becomes vertically aligned with keyway 50 and is lowered vertically along keyway 50, it will be apparent that the frame structure 22 becomes angularly oriented and postioned with respect to apparatus 10 and connector means 65 is aligned with mandrel 23 on apparatus 10.

In the event a different piece of well equipment is to be lowered by frame structure 22 and aligned with a receptacle 12, guide funnel assembly 68 may be modified so that key 100 is located in a different angular position within the cylindrical guide member 90. In such instances, the interior guide cylindrical member 90 may be replaced or the portions of arm 67 including the angularly disposed arms 76, 79 and partial box formed by walls 75, 83 and 84 may be completely replaced. In determining the angular position of key 100, it will be understood that the keyway 50 on the guide post means 20 is a fixed reference, guide posts means 20 being nonrotatable in its receptacle 31.

The automatically or remotely actuated guide post means 20 is constructed to be held in retracted position in sealed relation with the well apparatus 10 in diving bell mode. Further, the retractable guide post is adapted to be removed from receptacle 31 and returned to the surface for maintenance. Removal of the guide post means is accomplished by unscrewing bolts **31*b* by manipulator means to release plug 41, and then withdrawing piston and cylinder means 37 from receptacle 31. In retracted position, the guide post means is protected against possible damage by anchors or other equipment which might be dragged across the sea bottom. Since the guide post assembly is operated by a pressure fluid system carried therewithin, it is readily adapted to fail-safe operations where its extension may be automatic to provide connection to a single guide line, if desired, or to be used as a target cooperable with various types of reentry systems. A typical exemplary adaptation of the pressure fluid system of the guide post assembly to fail-safe operation may include connection of fluid pressure lines 53 and 54 to a suitable well known fluid pressure control means for controlling well equipment at the subsea station and employing a fluid pressure accumulator, not shown. Fluid pressure in line 54 normally holds the guide post in retracted position. When a fail-safe condition occurs, fluid pressure is relieved in line 54. The difference in pressure differential in lines 53 and 54 in the piston and cylinder means of the guide post causes extension of the guide post by the greater fluid pressure in line 53** which is in flow communication with the pressure accumulator.

Guide post means 20 in extended position serves as a target for remote controlled reentry systems to "home" on. In a cluster of subsea wells equipped with retractable and extendable guide post means 20 and operable in and under fail-safe conditions, a malfunctioning wellhead will cause the guide post means to be extended. The well having trouble is thereby physically identified with respect to other wells and may be readily selected by the reentry equipment for connection thereto.

Various modifications and changes may be made in the construction and arrangement of the guide post means and the cooperable guide funnel assembly, and all such changes and modifications coming within the scope of the appended claims are embraced thereby.

We claim:

1. In a reentry system for a subsea station having a well apparatus provided with protected receptacles for receiving well equipment lowered from the sea surface, the combination of:

an elongated guide post means on said apparatus;

one of said protected receptacles supporting and housing said guide post means in retracted position;

means for moving said guide post means into an extended exposed position;

engagement means cooperable with said guide post means for positioning an adaptor frame structure on said apparatus;

said engagement means including self-adjusting means for guiding cooperation of said frame structure with said guide post means.

2. In a system as stated in claim 1 wherein said self-adjusting means includes a gimbal means on said adaptor frame structure.

3. In a system as stated in claim 1 wherein said moving means includes a piston and cylinder means carried in said guide post means.

4. In a system as stated in claim 1 wherein said moving means includes fluid pressure actuating means remotely controlled.

5. In a system as stated in claim 1 including said means for moving said guide post means including a pressure fluid system;

and means cooperable with said moving means for extension of said guide post means under certain pressure fluid conditions in said pressure fluid system.

6. In a system as stated in claim 1 including latch means on said apparatus for prohibiting extension of said guide post means during service and maintenance operations at said apparatus.

7. In a system as stated in claim 1 wherein said adaptor frame structure includes a plurality of arms having ends each connected to a guide line, one of said arms carrying said engagement means intermediate its ends.

8. In a system as stated in claim 1 wherein said guide post means and said engagement means include cooperable means for orientation of said frame structure with respect to said apparatus.

9. In a system as stated in claim 1 wherein said engagement means includes a guide funnel carried by said adaptor frame structure;

and gimbal mounting means for said guide funnel.

10. In a system as stated in claim 9 including means on said frame structure and on said funnel adapted for lateral entry of a guide line into said funnel.

11. In a method of servicing a subsea well apparatus having a plurality of receptacles accessible from above and having a single guide post means normally retracted within said apparatus and unexposed above said apparatus; comprising the steps of:

causing said guide post means to be extended upwardly above said apparatus;

attaching a single guide line to said guide post means;

guiding an adaptor frame structure along said single guide line toward said guide post means;

engaging and self-adjusting said frame structure with respect to said guide post means;

and orienting said frame structure with respect to said apparatus for guiding service means into selected position with said apparatus.

12. In a reentry system for a subsea station having a well apparatus, the combination of:

a guide post means on said apparatus and adapted for connection to a single guide line;

a frame means having a guide funnel associated with said guide line for guiding said frame means to said apparatus and said guide funnel to said guide post means;

gimbal mounting means on said frame means for said guide funnel;

a key on said guide funnel;

and keyway means on said guide post means cooperable with said key for angularly orienting said frame means with respect to said well apparatus.

13. A reentry system as stated in claim 12 wherein said keyway means on said guide post means is fixed against rotation;

said guide funnel and key thereon being replaceable to provide a guide key in different angular orientation for positioning said frame means with respect to a different portion of said well apparatus.

14. In a reentry system for subsea well the combination of:

a subsea well apparatus;

a housing means on said apparatus;

a guide post means receivable within said housing means;

and means for extending and retracting said guide post means from and onto said housing means, said guide post means in extended position being exposed for selective cooperation with reentry means.

15. A reentry system as claimed in claim 14 including, a piston and cylinder means within said housing means, and a guide post member connected to said piston and cylinder means for movement therewith.

16. A reentry system as stated in claim 15 including a sealing member at the bottom of said housing means for closing said housing means in sealed relation, and means removably connecting one end of said piston cylinder means to said seal member.

* * * * *